US006457789B2

(12) United States Patent
Hällsten

(10) Patent No.: US 6,457,789 B2
(45) Date of Patent: Oct. 1, 2002

(54) CASSETTE INTENDED FOR THE CONSTRUCTION OF DRAWER CABINETS

(75) Inventor: Lars Hällsten, Täby (SE)

(73) Assignee: System Edstrom Biliredningar AB, Upplands Vasby (SE)

( * ) Notice: Subject to any disclaimer, the term of this patent is extended or adjusted under 35 U.S.C. 154(b) by 0 days.

(21) Appl. No.: 09/793,699

(22) Filed: Feb. 27, 2001

(30) Foreign Application Priority Data

Feb. 29, 2000 (SE) ..... 0000649

(51) Int. Cl.[7] ..... E05B 65/46
(52) U.S. Cl. ..... 312/333; 292/175; 292/169
(58) Field of Search ..... 312/332.1, 333, 312/215, 222; 292/175, 169; 70/85, 86, 81

(56) References Cited

U.S. PATENT DOCUMENTS 3,797,870 A * 3/1974 Beckman
4,639,052 A * 1/1987 Posso ..... 312/333
4,943,124 A * 7/1990 Dietz et al. ..... 312/222
5,603,559 A * 2/1997 Yemini ..... 312/333
5,775,140 A * 7/1998 Hallsten ..... 70/85
5,974,842 A * 11/1999 Schlack et al. ..... 292/175 X
6,161,909 A * 12/2000 Huang ..... 312/222 X

* cited by examiner

*Primary Examiner*—Janet M. Wilkens
(74) *Attorney, Agent, or Firm*—Young & Thompson

(57) ABSTRACT

A cassette intended for building up drawer cabinets, in which a drawer having a frontal piece is included, a lock is included in the drawer for locking of the same in the cassette. The lock includes a house located inside the frontal piece of the drawer and in connection with an opening therein, inside which house there is a spring-loaded plunger, which is movable vertically in relation to a hole in a bottom piece of the drawer, between a lower, locking position in which a free end of the plunger is behind and below an upper edge of a flange in a frontal frame of the cassette, and an upper, opening position in which the free end of the plunger is located above the flange and goes free therefrom. By the location thereof in the bottom part of the drawer, the lock guarantees that heavily loaded thereby deformed drawers do not risk to unintentionally be pulled out from the cassette.

3 Claims, 6 Drawing Sheets

CASSETTE INTENDED FOR THE CONSTRUCTION OF DRAWER CABINETS

TECHNICAL FIELD OF THE INVENTION

Figure 1:
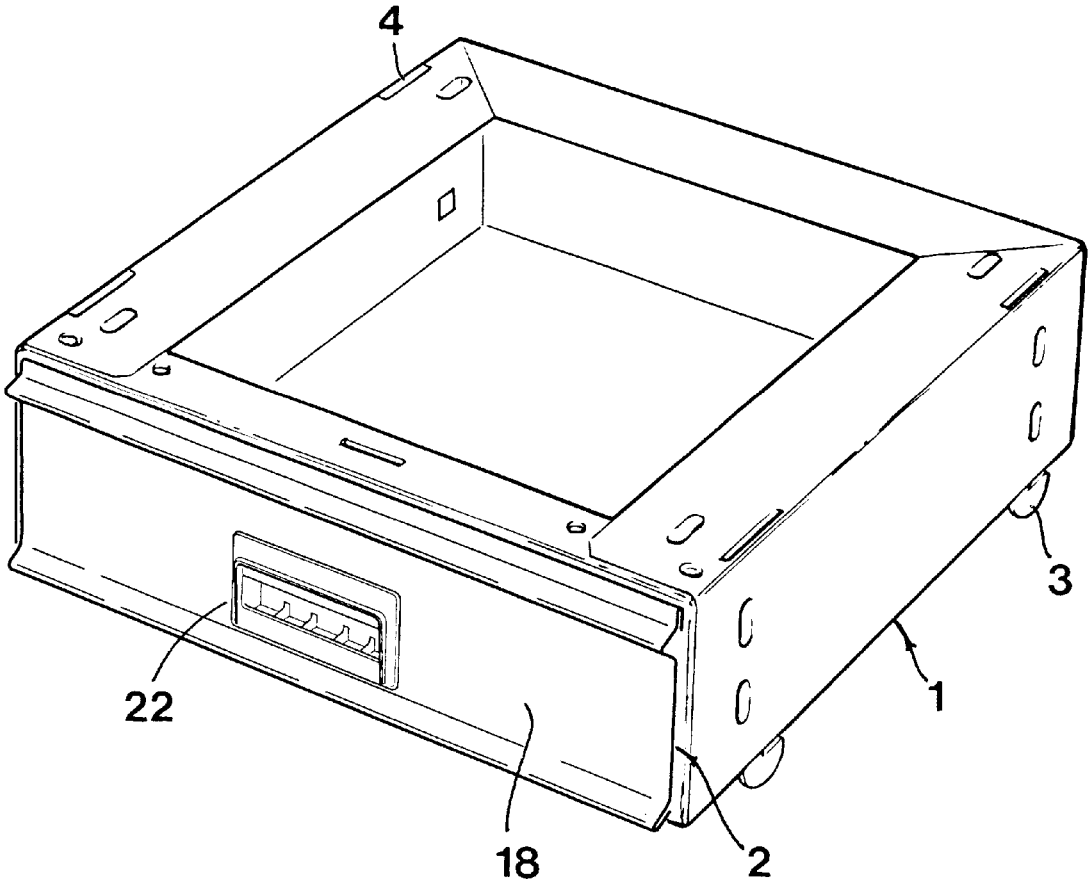

This invention relates to a cassette intended for building up drawer cabinets of the type that accommodates a drawer and includes, on one hand, a rectangular frontal frame from which four walls extend, viz a bottom wall, two side walls and an upper wall, and, on the other hand, a rear wall to which said walls are connected, and which frontal frame has at least one lower, vertical flange in connection with the first-mentioned walls, the drawer in addition to a back piece including a bottom piece, two side pieces as well as a frontal piece in which a lock is arranged for locking the drawer in relation to the cassette.

PRIOR ART

A cassette for a drawer cabinet of the above-mentioned type is previously known by EP 739 178. Drawer cabinets built up of such cassettes are frequently installed in service vehicles of different types and are used for storage of miscellaneous objects and utensils that need to be at hand for the mobile service personnel which make use of the vehicle. For instance, tools and expendable components, such as screws, nuts, couplings, etc. may be stored in the drawers of the drawer cabinets.

The cassette for a drawer cabinet known by EP 739 178 includes a lock which per se does not have the purpose of theftproofing the drawer, but instead retain the same in the pushed-in position in the cassette and if required allow the pulling out of drawer. Characteristic of this known lock is that the same is mounted in an upper part of the frontal piece of the drawer and includes a turnably movable, hook-shaped lock plunger which in the locking position should engage behind an upper flange in the rectangular frontal frame of the cassette. In order to turn the plunger between locking and disengaging positions, the lock furthermore includes a handle. This has a profile shape that corresponds with the profile shape of a gripping flange, which protrudes from the upper edge of the frontal piece of the drawer. More precisely, the handle is placed in a central recess in the gripping flange in order to be located, in the locking state of the lock, in line with the rest of the gripping flange.

A disadvantage of this known cassette for a drawer cabinet has, however, turned out be that the function of the lock may be jeopardized during extreme conditions. Thus, in particular wide drawers (drawers having a width of 600 mm) may be subjected to bending deformation when they are filled with heavy objects. More precisely, the intermediate portion of the drawer then sinks down in relation to the sides. Since the upper flange of the frontal frame of the cassette behind which the lock plunger should engage is comparatively narrow (usually approx. 5 mm), the free end portion of the plunger which in practice is capable of engaging against the flange becomes very short (usually approx. 2–3 mm). Therefore, if the drawer sinks down some millimeters in the middle, the lock plunger risks to lose the locking grip thereof against the flange when the drawer at the same time happens to be subjected to unintentional tractive forces. Thus, when cornering during the ride of the vehicle, it has occurred that heavy loaded and thereby somewhat deflected drawers have been subjected to such large centrifugal forces that they unintentionally have been pulled out from the cassette; something which may have drastic consequences by virtue of the objects stored in the drawers having been thrown out in an uncontrolled way. Another disadvantage of the previously known cassette for a drawer cabinet is that the handle of the lock and surrounding parts of the gripping flange of the frontal piece of the drawer protrudes from the outside of the frontal piece of the drawer. This means that the handle and the gripping flange occupy a certain space in the area in front of the drawer cabinet. Therefore, in the very narrow space that is present in a passage between opposite rows of drawer cabinets in a vehicle, the handle contributes to a limitation of the operator's possibilities to move between the rows of drawer cabinets.

OBJECTS AND FEATURES OF THE INVENTION

The present invention aims at obviating the above-mentioned disadvantages of the previously known cassette for a drawer cabinet and at providing an improved cassette. Therefore, an object of the invention is to provide a cassette for a drawer cabinet in which the drawer is secured in a reliable way in the pushed-in position thereof in the cassette and in which the risk of unintentional pulling-out of the drawer is obviated. An additional object is to create a cassette for a drawer cabinet, the drawer of which may be unlocked and pulled out by means which do not protrude from the outside of the frontal piece of the drawer.

Further Elucidation of Prior Art

By SE 150773, a lock intended for securing drawers is previously known which has a plunger being mounted in the lower edge of a frontal piece of the drawer. However, this lock includes a house which in its entirety is located outside the frontal piece of the drawer and opens downwards in order to permit the action of a button, by means of which the lock plunger may be lifted up from the locking position thereof. A lock house projecting in this way is inappropriate in connection with drawers of drawer cabinets of the type that the invention relates to.

BRIEF DESCRIPTION OF THE APPENDED DRAWINGS

Figure 2:
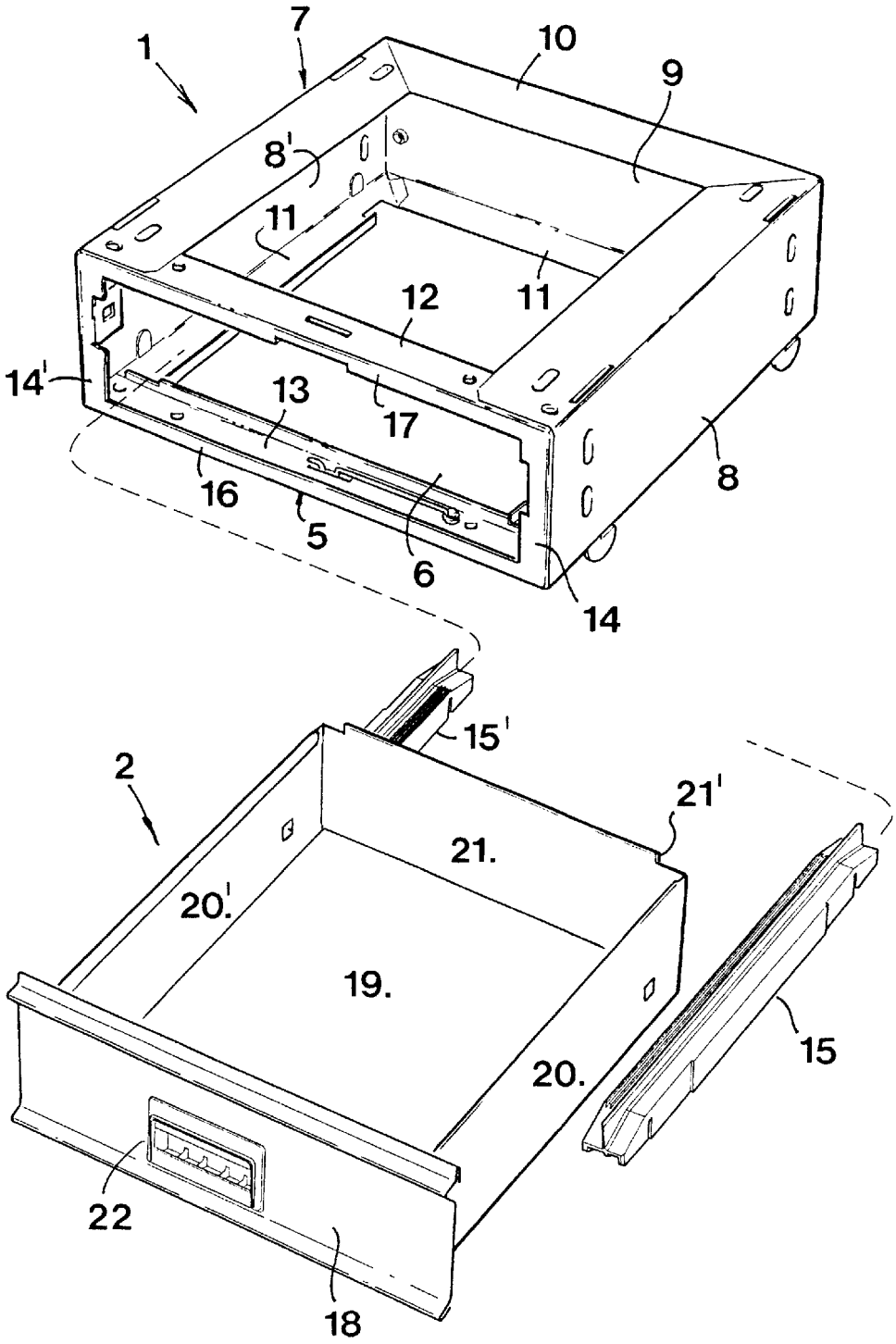
Figure 4:
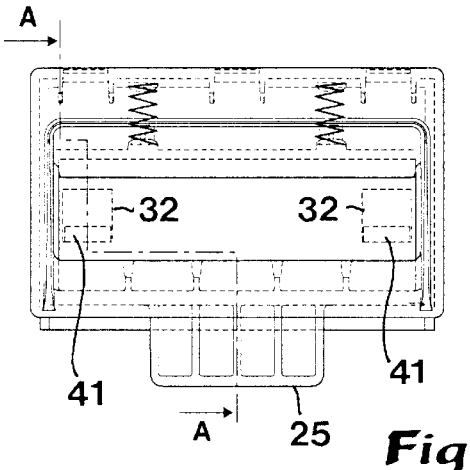
Figure 3:
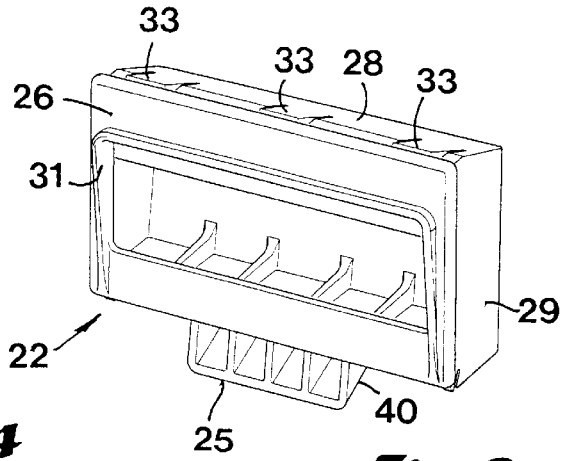
Figure 5:
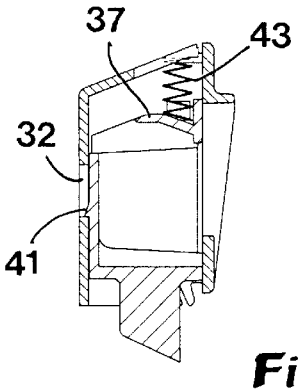
Figure 6:
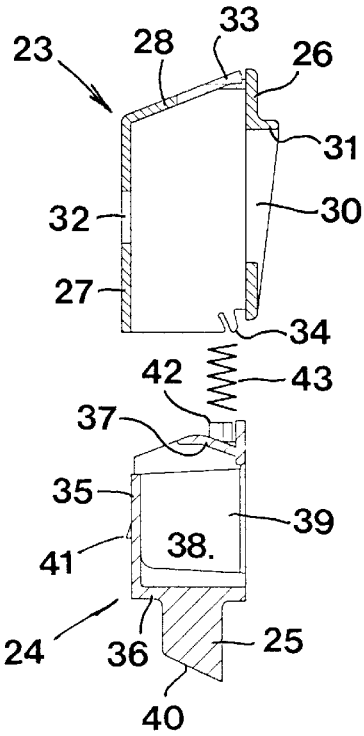
Figure 7:
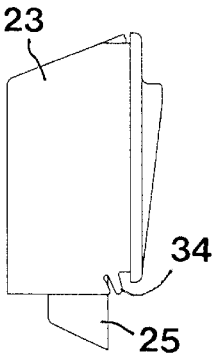
Figure 8:
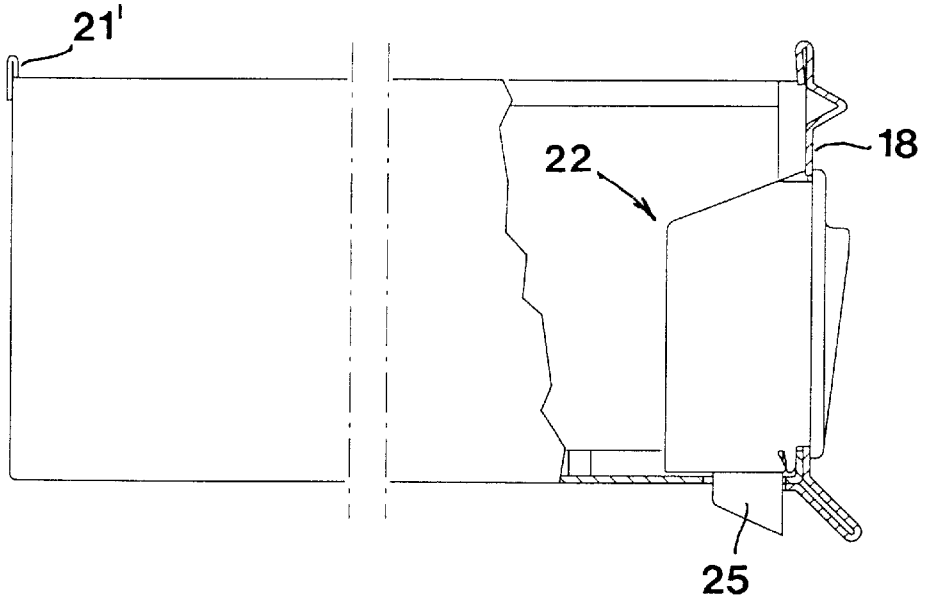
Figure 9:
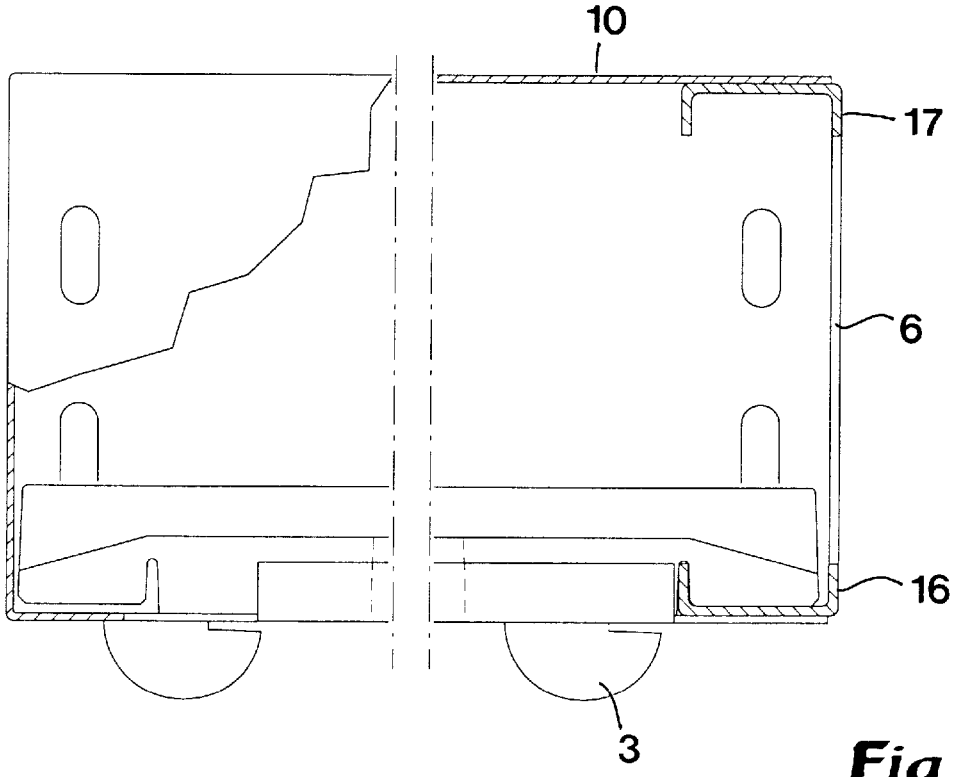
Figure 10:
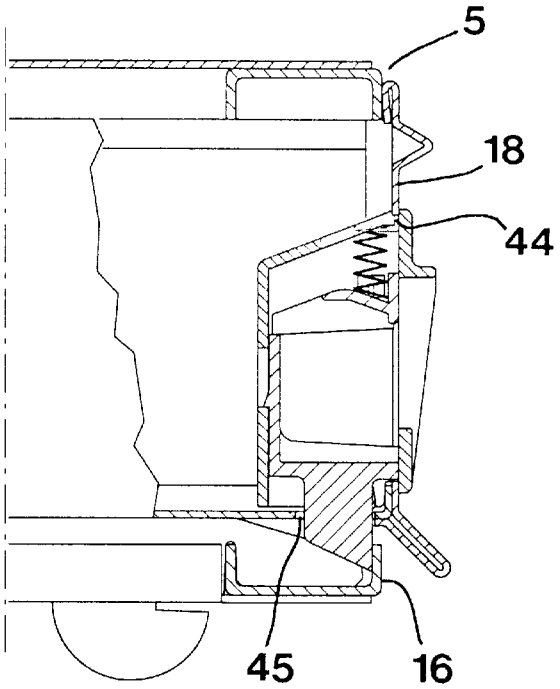
Figure 11:
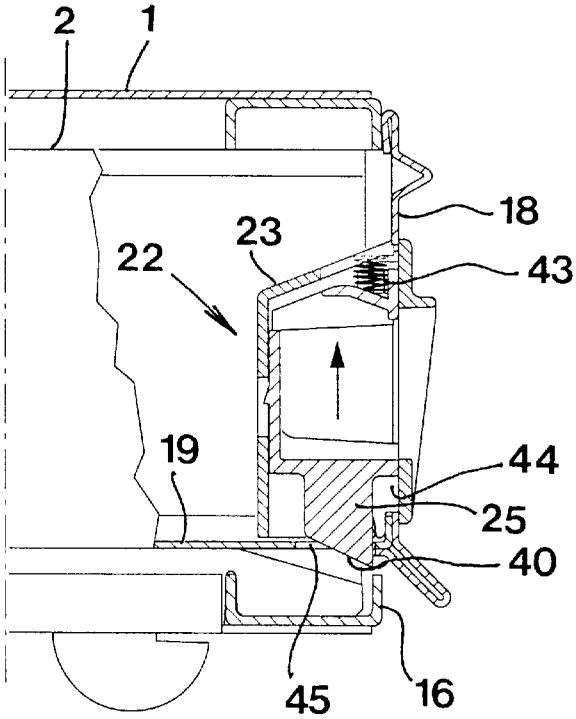
Figure 12:
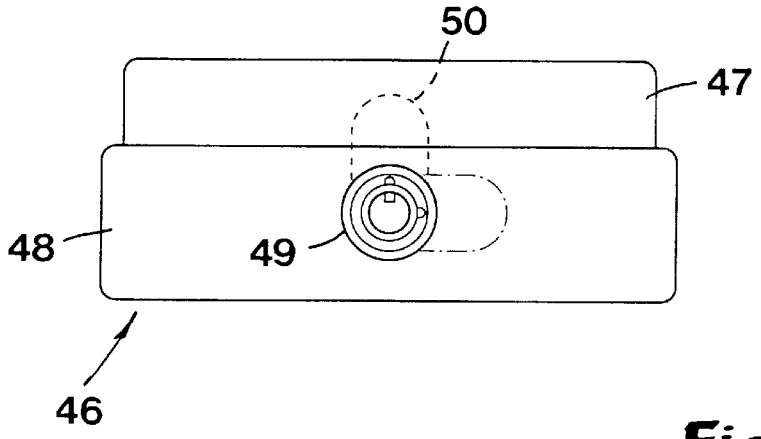
Figure 13:
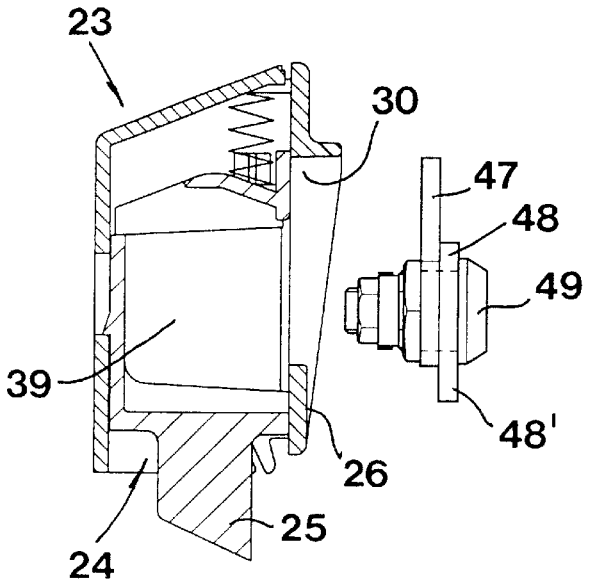
Figure 14:
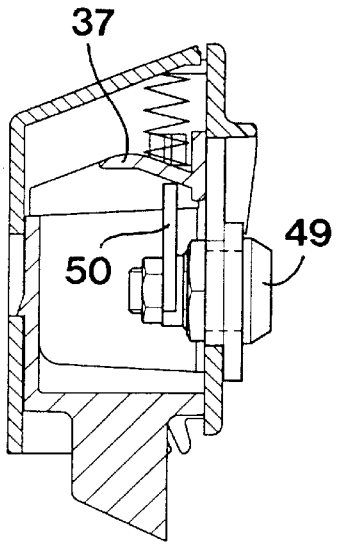

In the drawings:

FIG. 1 is a perspective view showing a cassette for a drawer cabinet made according to the invention, the drawer of which is inserted in the cassette, FIG. 2 is an exploded view of the same cassette with the drawer shown spaced-apart from the proper cassette, FIG. 3 is a perspective view of a lock included in the drawer, FIG. 4 is a partly transparent front view of the lock according to FIG.3, FIG. 5 is a cross-section A—A in FIG. 4, FIG. 6 is a cross-section corresponding to FIG. 5 which shows a plunger slide spaced-apart from a house included in the lock, FIG. 7 is a side view of the same lock, FIG. 8 is a partly cut side view of the drawer, the lock according to FIGS. 4–7 being shown mounted in the drawer, FIG. 9 is a partially cut side view showing the cassette without a drawer, FIG. 10 is a partially cut side view showing the drawer inserted in the cassette, the lock being in a locking state, FIG. 11 is a side view corresponding to FIG. 10 showing the lock in a disengaging state, FIG. 12 is a front view of a theftproofing supplement to the lock according to the invention, FIG. 13 an exploded view, partly in section, showing the supplement in connection with the lock, although separated therefrom, and FIG. 14 a section through the lock showing the supplement mounted in the same.

DETAILED DESCRIPTION OF A PREFERRED EMBODIMENT OF THE INVENTION

In FIG. 1, a cassette for a drawer cabinet is shown which includes two main components, viz. a proper cassette 1 and a drawer 2, which in FIG. 1 is inserted in the cassette. On the bottom side of the cassette 1, there are four hook-members 3 which are insertable in a corresponding number of slits 4 in the top side of another cassette in order to interconnect, in a simple way, a suitable number of cassettes so as to form a drawer cabinet having a desired height.

In FIG. 2 is seen how the cassette 1 is composed of a frontal frame, in its entirety designated 5, which defines a frontal opening 6 for receiving the drawer 2, as well as a back piece, in its entirety designated 7. This back piece includes two side walls 8, 8' as well as a rear wall 9. The back piece 7 may be made of a single continuous, suitably thin-walled piece of metal sheet, which is punched out of a blank and bent into U-form as seen cross-section-wise as well in contour. In this connection, both upper horizontal flanges 10 as well as lower, likewise horizontal flanges 11 are formed along each one of the walls 8, 8', 9. The upper flanges 10 are situated in a common plane and form an upper wall or part of the cassette 1. In an analogous way, also the lower flanges 11 are situated in a common, horizontal plane while forming a lower wall or part of the cassette. The free ends of the U-profiles that are formed by the side walls 8, 8' surround the frontal frame 5 and are connected thereto in a suitable way, e.g. by spot-welding or pressing. Advantageously, also the frontal frame 5 is manufactured from thin sheet-metal, which by punching and bending has been given a U-shaped cross-section. The frontal frame includes a top piece 12, a bottom piece 13 and two vertical side pieces 14, 14'. Along the lower flanges 11 of the side walls 8, 8', guide rails 15, 15' are arranged along which the drawer 2 is displaceable and guided.

The top piece 12 as well as the bottom piece 13 of the frontal frame 5 have a U-shaped cross-section. Therefore, there is a comparatively narrow, vertical lower flange 16 adjacent to the front edge of the bottom piece 13. Correspondingly, the top piece 12 has a narrow, vertical upper flange 17.

The drawer 2 includes a frontal piece 18, a bottom 19, two side pieces 20, 20' as well as a back piece 21. These components, which advantageously consist of bent thin metal sheet, together form a substantially parallelepipedical drawer. The frontal piece 18 is larger than the back piece 21, which in turn is only slightly narrower than the frontal opening 6 of the cassette 1. An upper portion 21' of the back piece protrudes somewhat from other parts of the upper edge of the drawer and has the purpose of retaining the drawer in a maximum pulled-out position. Therefore, in the pushed-in state of the drawer, the frontal piece 18 will, in all essentials, entirely cover the frontal frame being behind, as is seen in FIG. 1. In the frontal piece 18 of the drawer, a lock 22 is included.

As far as the depicted cassette construction has been described hitherto, the same is in all essentials previously known by EP 739 178.

Reference is now made to FIGS. 3–11, which in detail illustrate the nature of the lock 22. As best is seen in FIG. 6, the lock includes two main components, viz. a house 23 and a slide 24 in which a lock plunger 25 is included. The house 23 is open downwards and comprises a frontal wall 26, a rear wall 27, a top wall 28 as well as two side walls 29. In the frontal wall 26, an opening 30 is formed which partly is surrounded by a U-shaped border 31. In the rear wall 27, there are two recesses 32. In the top wall 28, three spaced-apart tongues 33 of an elastical flexible nature are formed. The free end of each such tongue ends at a certain distance from the inside of the frontal wall 26. In the area of the frontal and lower corner of each side wall 29, a finger-like projection 34 is formed, which extends obliquely downwards/outwards and is located at a certain distance behind the inside of the frontal wall 26.

The slide 24 includes a rear wall 35, a bottom wall 36 and a top wall 37, which together with two opposite side walls 38 define a cavity 39 which is open in the forward direction. The plunger 25 extends downwards from the bottom wall 36 and has an obliquely inclined surface 40 which extends obliquely upwards/backwards from a lower edge of the plunger. on the outside of the rear wall 35, two projections are formed in the shape of cross-section-wise wedge-shaped lugs 41. These lugs are delimited by a lower surface which extends perpendicularly to the wall 35 and an upwardly directed surface which is oblique as a consequence of the lug tapering in the direction upwards. It should also be mentioned that two pins 42 are formed on the upper side of the top wall 37. These pins have the purpose of receiving compression springs in the form of screw compression springs 43.

The house 23 and the slide 24 are in practice produced of plastic, which gives at least the house but preferably also the slide, certain flexibility. By being made of plastic, the two components 23, 24 may be manufactured in large series at low costs.

When the slide 24 and the house 23 are to be assembled, the springs 43 are applied on the pins 42, and thereafter the slide 24 is inserted from below into the house 23. In doing so, the oblique surfaces of the lugs 41 permit that the slide is pressed into the interior of the house while the walls 27 and 35 are deformed elastically to a certain extent. As soon as the lugs 41 reach the recesses 32, the slide is snapped in the house in that the transverse lower surface of each lug blocks the slide from being removed from the house. In the position shown in FIG. 5, the individual stop lug 41 abuts against the lower edge of the recess 32. In doing so, the slide together with the plunger 25 assume a lower end position from which the slide may be lifted up against the action of the springs 43, more precisely by sticking in one or more fingers into the cavity 39 of the slide via the opening 30 in the frontal wall of the house, whereafter the fingers are pressed against the top wall 37 and press this upwards.

In FIGS. 8, 10 and 11, the assembled lock is shown applied in the frontal piece 18 of the drawer. In this frontal piece, an opening 44 is formed, the size of which corresponds to the size of the lock house. The opening is located in the lower part of the frontal piece and halfway between the two opposite ends of the frontal piece. In close proximity to the frontal piece, a hole 45 for the lock plunger 25 is recessed in the bottom wall 19 of the drawer. The mounting of the lock in the frontal piece takes place by snapping. More precisely, the lower part of the lock house is inserted through the opening 44, the plunger 25 being inserted into the hole 45. In this initial step, the lower edge portion of the frontal piece defining the opening 44 is brought in between the two elastic fingers 34 and the frontal wall 26 of the lock house. Then, when the upper part of the house is pressed into the opening by turning the house, the elastic tongues 33 springs away until the frontal wall 26 is in contact with the frontal piece of the drawer. In doing so, the tongues 33 springs back to the starting position thereof and snaps the lock house in a ready-mounted position by being pressed against the inside of the upper edge portion of the frontal piece defining the opening 44. In addition, the elastic fingers 34 will continuously be held resiliently pressed against the inside of the frontal piece 18.

In FIG. 10, the lock is shown in a locking state. In this state, the slide and the lock plunger thereof assume a lower end position in which the lugs 41 abut against of the lower limiting surfaces of the recesses 32 at the same time as the plunger projects down through the hole 45 and abuts, with the lower end portion thereof, against the inside of the lower flange 16 of the frontal frame 5 of the cassette. When the drawer is to be unlocked and drawn out to the outer end position thereof in relation to the cassette, one or more fingers are stuck into the cavity 39 of the slide and are pressed against the top wall 37 of the slide, whereby the slide and the plunger are lifted to an upper position according to FIG. 11. In this way, the lower end of the plunger 25 is located on a level above the flange 16 so that the plunger goes free. As soon as the fingers are removed from the slide, the same returns to the starting position thereof by means of the springs 43.

By the construction and location thereof, the described lock locks the drawer in the area of the bottom part of the drawer. Therefore, if the drawer would be heavily loaded and subjected to bending deformation, there is no risk that the lock plunger looses the locking engagement thereof with the cassette. On the contrary, an increasing weight load entails an even safer locking of the drawer.

An important advantage of the cassette according to the invention is that the drawer does not have any markedly projecting gripping members. Thus, the gripping of the drawer is executed by the fact that the fingers of the hand are stuck into the lock house, the pulling-out of the drawer being carried out by application of a horizontal pulling force on the house and the drawer when the lock plunger has been unlocked.

In FIGS. 12–14, a supplement lockable by means of a key is illustrated which advantageously may be used together with the lock according to the invention in order to theft-proof the drawer of the cassette is so required. This supplement is in its entirety designated 46 and includes a plate 47, which in the main has the same contour shape as the frontal opening 30 in frontal wall 26 of the lock house 23. Thus, the plate 47 is rectangular and has substantially the same length and height as the opening 30. The plate 47 is integrated with an external second plate 48, that has as a lower flange 48' which protrudes downwards a distance from the lower edge of the plate 47, as well as side flanges which protrude somewhat from the side edges of the plate 47. In practice, the plates 47, 48 may be casted in one single piece of plastic. Centrally in the supplement, a locking mechanism 49 is mounted of the type that is actuable by a key (not shown). In the locking mechanism, a finger 50 is included, which is turnable 90° by means of the key, more precisely between an upwards pointing, locking position, in which the finger abuts against the top wall 37 of the slide 24, and a horizontal, unlocked position. When the plate 47 is inserted into the opening 30 and fills this up at the same time as the finger 50 is positioned in the locking position according to FIG. 14, access to the cavity 39 in the slide is made impossible; something which in turn prevents removal of the lock plunger 25 from the locking position according to FIG. 10.

In this connection, it should be mentioned that the lock shown in the drawings is intended for wide cassettes for drawer cabinets (600 mm or more). For cassettes for drawer cabinets having smaller dimensions, the lock may be of a simpler embodiment. The lock may, for instance, then have such a limited width that only one finger may be inserted in the cavity of the plunger slide.

What is claimed is:

1. Cassette (1) intended for building up drawer cabinets of the type that accommodates a drawer (2) and includes, on one hand, a rectangular frontal frame (5) from which four walls extend, a bottom wall (11), two side walls (8, 8') and an upper wall (10), and on the other hand, a rear wall (9) to which said walls are connected, and which frontal frame (5) has at least one lower, vertical flange (16) in connection with the first-mentioned walls, the drawer, (2) in addition to a back piece (21) including a bottom piece (19), two side pieces (20, 20') as well as a frontal piece (18) in which a lock (22) is arranged for locking the drawer relative to the cassette, characterized in that the lock (22) includes a house (23) located inside the frontal piece (18) of the drawer and in connection with an opening (44) therein, inside which house there is a spring-activated plunger (25), which is movable vertically in relation to a hole (45) in the bottom piece (19) of the drawer, between, on one hand, a lower, locking position in which a free end of the plunger (25) is behind and below an upper edge of said lower flange (16) of the frontal frame of the cassette, and in which the plunger makes the pulling-out of the drawer from the cassette impossible, and, on the other hand, an upper, opening end position in which the free end of the plunger is located above the upper edge of said lower flange and goes free therefrom to enable the pulling-out of the drawer, and that the lock house (23) has a frontal opening (30) in flush with the opening (44) in frontal piece (18) of the drawer (2), and that a slide (24) carrying the plunger (25) is arranged inside the house, which slide defines a forwardly open cavity (39) and includes a top wall (37) positioned above the cavity, which top wall is accessible via said openings (30, 44) in the house and the frontal piece of the drawer to permit the lifting of the slide together with the plunger against the action of at least one spring (43) arranged between the house and the slide, which spring always aims at bringing the plunger to the locking, lower position.

2. Cassette according to claim 1, characterized in that the lock house (23) is fixed in the opening (44) of the frontal piece of the drawer by snap means in the form of two lower projections (34) placed at a distance inside a frontal wall (26) of the house, as well as at least one elastically flexible tongue (33), which is included in a top part (28) of the house and has a free end situated at a distance inside the upper part of the frontal wall (26).

3. Cassette according to claim 1, characterized in that the slide (24) in a rear wall includes at least one wedge-shaped stop lug (41), which is located in a recess (32) in a rear wall (27) of the house (23) and has a lower surface extending transversely to the slide wall, as well as an oblique rear surface, which permits the pressing-in of the slide into the interior of the house in connection with the assembly of the slide and the house, the transverse surface on the lug serving as a stop surface which controls the lower end position of the slide, and thereby of the plunger, in relation to the house.

* * * * *